US006315675B1

(12) United States Patent
Ho

(10) Patent No.: US 6,315,675 B1
(45) Date of Patent: Nov. 13, 2001

(54) SCORE COUNTER FOR BILLIARDS GAME

(76) Inventor: Tsai Chin Ho, 11F-2, No. 43, Chai-I Street, Taichung City (TW)

( * ) Notice: Subject to any disclaimer, the term of this patent is extended or adjusted under 35 U.S.C. 154(b) by 0 days.

(21) Appl. No.: 09/523,928

(22) Filed: Mar. 13, 2000

(51) Int. Cl.[7] ..... A63D 15/00

(52) U.S. Cl. ..... 473/1; 473/18; 473/20; 273/DIG. 26; 273/244; 434/174; 434/189; D21/372; 235/68; D18/6

(58) Field of Search ..... 40/491, 358, 582; D19/64; D18/2, 6; D21/344, 372; D10/46.1; 273/143 R, 244, 126 R, 148 R, 281, DIG. 26; 473/FOR 1–31; 235/68, 123; 434/167, 172, 174, 203, 402, 215

(56) References Cited

U.S. PATENT DOCUMENTS

D. 322,465 * 12/1991 Beck ..... D21/372
596,665 * 1/1898 Porter ..... 235/68
1,122,894 * 12/1914 Fisher ..... 473/1
1,265,761 * 5/1918 Ehrenhardt et al. ..... 276/126 R
1,792,166 * 2/1931 Horstmann ..... 473/1
3,633,287 * 1/1972 Squires ..... 434/189
3,674,905 * 7/1972 Collins, Sr. ..... 434/174
4,123,853 * 11/1978 Dickensheet ..... 434/184
4,171,807 * 10/1979 Lamlee ..... 473/18

* cited by examiner

*Primary Examiner*—Jeanette Chapman
*Assistant Examiner*—Mitra Aryanpour
(74) *Attorney, Agent, or Firm*—Charles E. Baxley, Esq.

(57) ABSTRACT

A score counter includes a bar having two spheres on two ends thereof so as to fix the bar by engaging the two spheres with relative members. A plurality of retaining members each have a score marked therein and extend from an outside of the bar. A plurality of blocks are slidably mounted to the bar and each block is separated by the retaining members on the bar. The hole is sized that the user can move the block over the retaining members by force. The blocks on the bar are separated by the retaining members.

6 Claims, 4 Drawing Sheets

SCORE COUNTER FOR BILLIARDS GAME

FIELD OF THE INVENTION

The present invention relates to a score counter for billiards game and includes a bar with ridges extending at a predetermined interval so that the score blocks movably mounted to the bar and can be positioned by the ridges.

BACKGROUND OF THE INVENTION

A conventional score counter device 1 for billiards is shown in FIGS. 1 and 2 and generally includes a bar 11 with two positioning spheres 10 on two ends of the bar 11. Each of the sphere 10 has a passage 101 defined therethrough so as to be cooperated with relative fixture of the billiard appliance. A plurality of score blocks 2 are slidably mounted on the bar 11 and each block 2 has a score marked on the block 2. Score counting persons slide the blocks 2 to illustrate scores that players own. Although the bar 11 is installed in horizontal, the blocks 2 each have a hole 20 through which the bar 11 extends, the hole 20 in each block 2 is slightly larger than the bar 11 so that the blocks 2 tend to slide along the bar 11 when a force is applied to the blocks 2. It is not convenient for the score counting persons to position the blocks 2.

The present invention intends to provide a score counter for billiards wherein the bar has ridges extending from an outside of the bar and the blocks each have a hole through which the bar extends. The size of the hole allows the blocks to a pass over the ridges by force and each block is positioned between ridges.

SUMMARY OF THE INVENTION

In accordance with one aspect of the present invention, there is provided a score counter comprising a bar having two spheres on either ends thereof so that the bar is fixed by the two spheres. A plurality of retaining members extend from an outside of the bar and a plurality of blocks are slidably mounted on the bar. Each block has a hole defined therethrough for the bar extending through the holes. The blocks are separated by the retaining members on the bar and the blocks can be slid along the bar by moving the blocks over the retaining members with force.

The object of the present invention is to provide a score counter for billiards wherein the bar has retaining members on an outside of the bar so that the blocks cannot slide along the bar freely.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
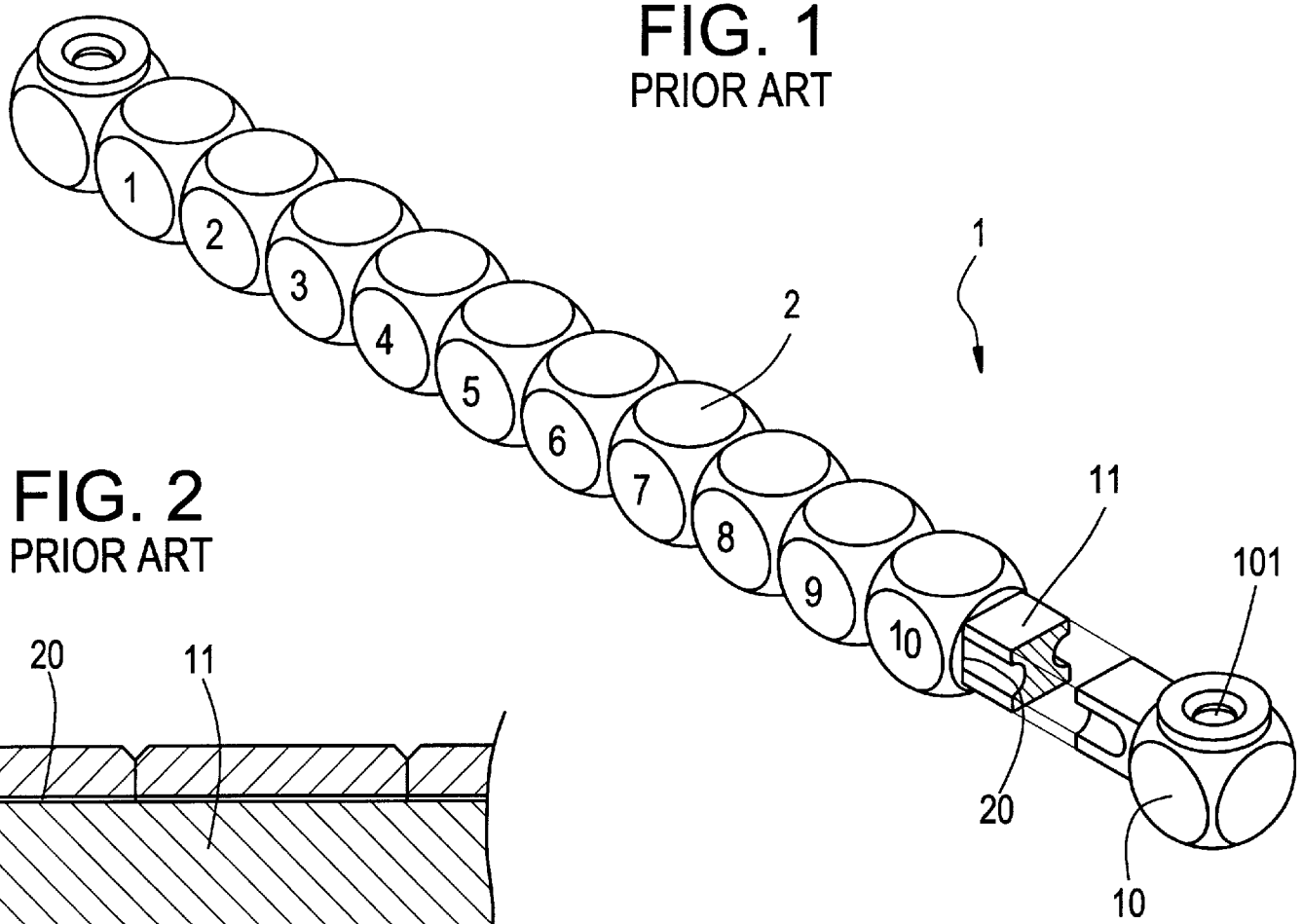
FIG. 1 PRIOR ART
FIG. 1 is a perspective view to show a conventional score counter wherein a section of the bar is removed for illustrative purpose.
Figure 2:
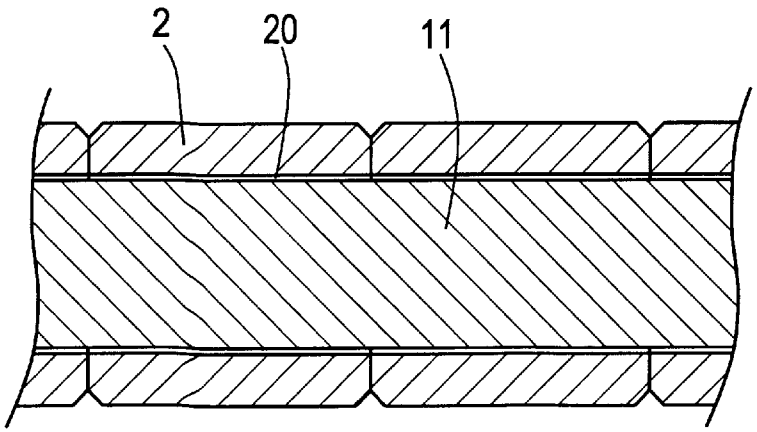
FIG. 2 PRIOR ART
FIG. 2 is a side elevational view, partly in section, of the conventional score counter.
Figure 3:
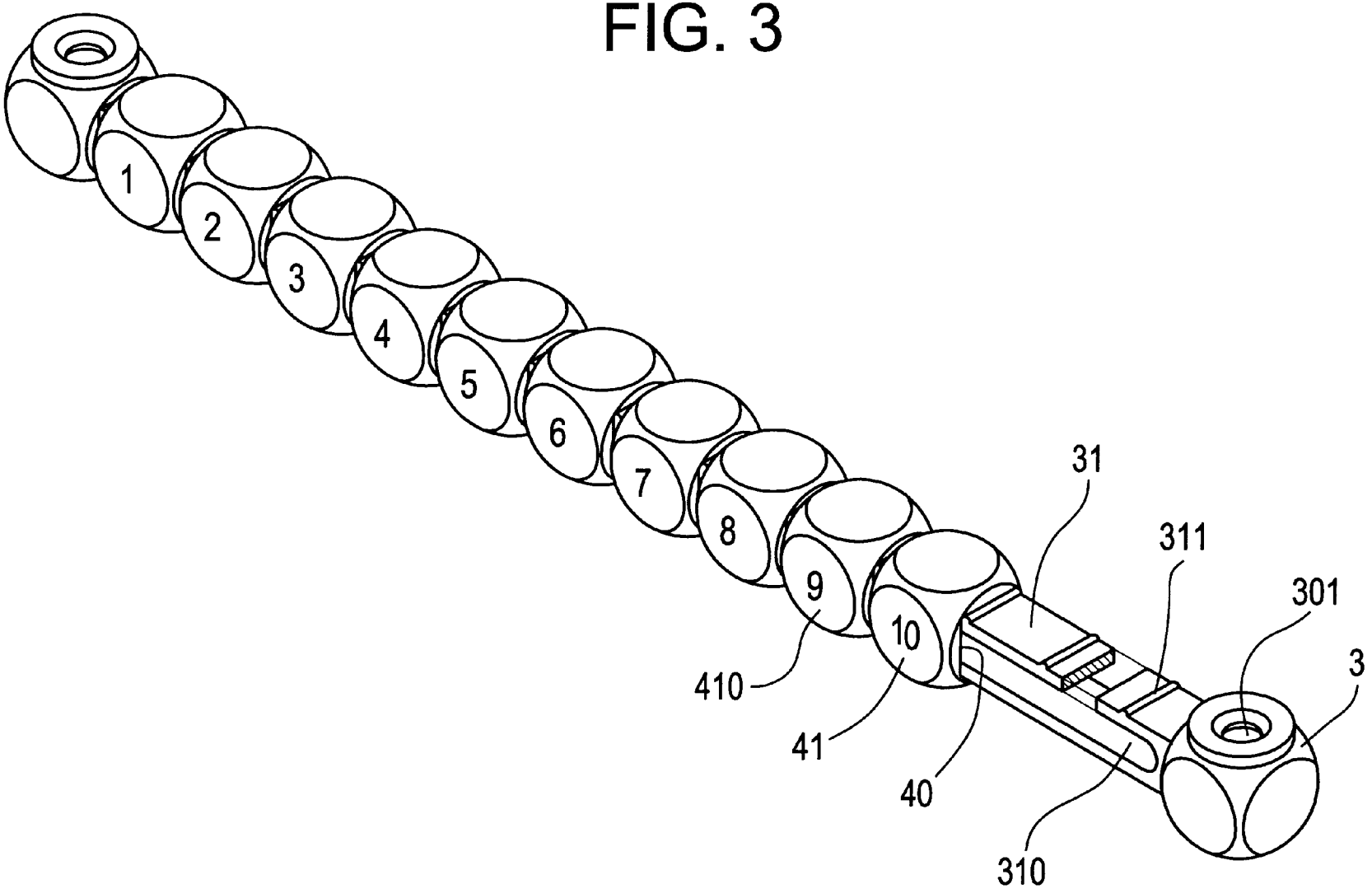
FIG. 3 is a perspective view to show a score counter of the present invention wherein a section of the bar is removed for illustrative purpose.
Figure 4:
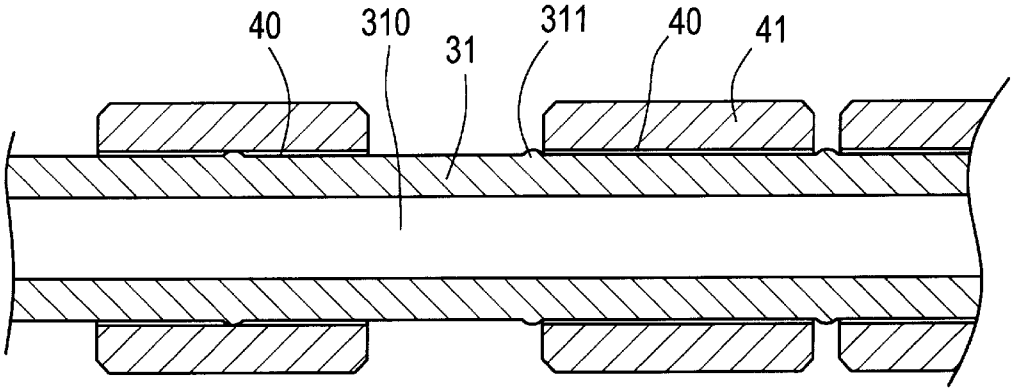
FIG. 4 is a side elevational view, partly in section, of the score counter of the present invention wherein the blocks are separated by the retaining members and one of the blocks is moved over the retaining members.
Figure 5:
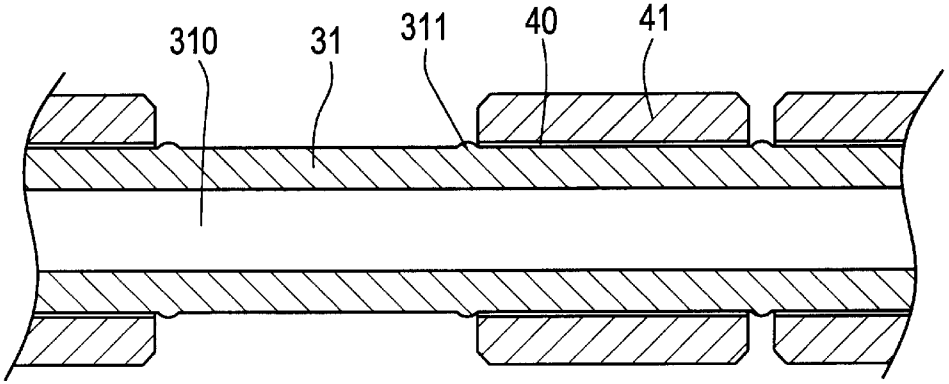
FIG. 5 is a side elevational view, partly in section, of the score counter of the present invention wherein the blocks are separated by the retaining members.

Referring to FIGS. 3 to 5, the score counter in accordance with the present invention comprises a bar 31 (having two spheres 30 on two ends of the bar 31 and each sphere 30 has a passage 301 defined therethrough so as to be connected with relative fixtures to be fixed to the bar. The bar 31 has a rectangular cross section and a groove 310 is defined in a side of the bar 31. The retaining members 311 extend, from two opposite sides of the bar 31. The retaining members 311 can be a ridge extending transversely from the bar 31. A plurality of blocks 41 are slidably mounted on the bar and each block 41 has a hole 40 defined therethrough so that the bar 31 extends through the holes 40 of the blocks 41. Each block 41 has a score 410 illustrated on an outside thereof. The hole 40 of each block 41 is sized that the blocks 41 can be moved over the retaining members 311 by force as shown in FIG. 4. As shown in FIG. 5, the blocks 41 are separated by the retaining members 311 on the bar 31 and the blocks 41 cannot move over the retaining members 41 if a force applied to the blocks 41 is not large enough. Accordingly, the blocks 41 can be positioned at a position where the score counting person shifts them to and will not slide even if the bar 31 is hit unintentionally.

Figure 6:
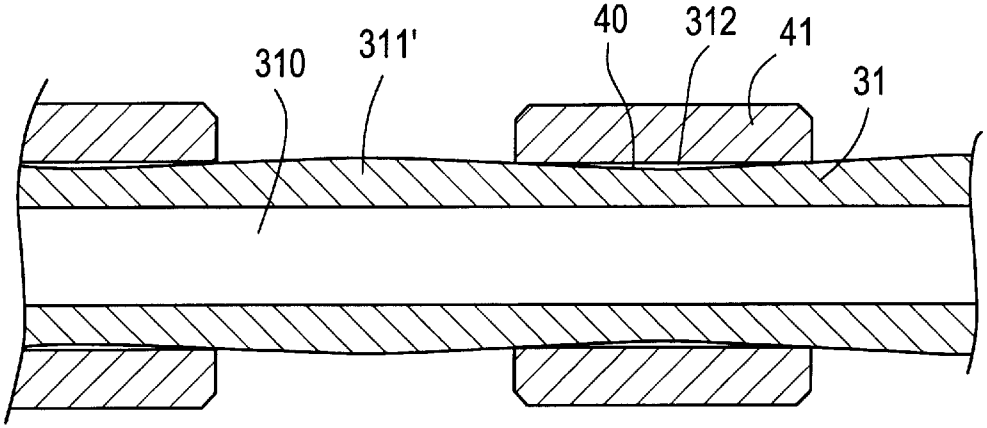
FIG. 6 is a side elevational view, partly in section, of another embodiment of the score counter of the present invention wherein the bar has convex portions and annular recesses.

FIG. 6 shows another embodiment of the bar 31 wherein an annular recess 312 is defined between two adjacent retaining members 311' and the retaining members 311' are annular convex portions extending from the outside of the bar 31. When the blocks 41 move over the convex portions, the score counting person should use a larger force.

Figure 7:
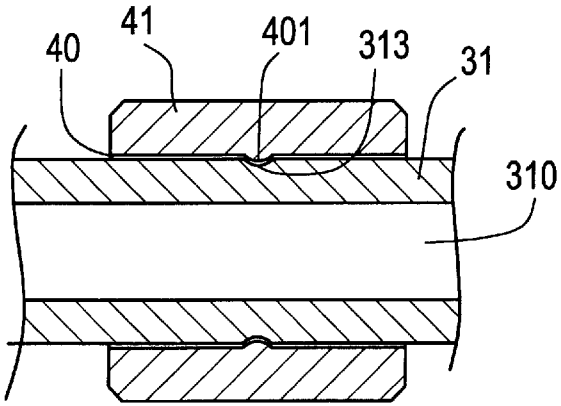
FIG. 7 is a side elevational view, partly in section, of yet another embodiment of the score counter of the present invention wherein the bar has notches and the blocks has bosses which are to be engaged with the notches.

FIG. 7 shows yet another embodiment of the score counter of the present invention wherein the bar 31 has notches 313 defined in an outside thereof and the blocks 41 each have a boss 401 extending from an inside of the hole 40 defined through the block 41. The bosses 401 are to be engaged with the notches 313. The bosses 401 are disengaged from the notches 313 by pushing the blocks 41 along the bar 31. Therefore, when the bosses 401 are engaged with the notches 313, the blocks 41 are positioned until the score counting person moves them again.

While we have shown and described various embodiments in accordance with the present invention, it should be clear to those skilled in the art that further embodiments may be made without departing from the scope and spirit of the present invention.

What is claimed is:

1. A score counter comprising:

a bar having two spheres on two ends of said bar, each sphere having a passage defined therethrough, a plurality of retaining members extending from an outside of said bar, and a plurality of blocks slidably mounted on said bar and each block having a hole defined therethrough, said bar extending through said holes of said blocks, said blocks being separated by said retaining members on said bar.

2. The score counter as claimed in claim 1, wherein said bar has a rectangular cross section and said retaining members extend from two opposite sides of said bar.

3. The score counter as claimed in claim 1, wherein each of said retaining members is a ridge extending transversely from said bar.

4. The score counter as claimed in claim 1 further comprising an annular recess defined between two adjacent retaining members.

5. The score counter as claimed in claim 4 wherein said retaining members are annular convex portions extending from said outside of said bar.

6. A score counter comprising:

a bar having two spheres on two ends of said bar, each sphere having a passage defined therethrough, a plurality of notches defined in an outside of said bar, and a plurality of blocks slidably mounted to said bar and each block having a hole defined therethrough, said bar extending through said holes of said blocks, said blocks each having a boss extending from an inside of said hole and said boss disengagably engaged with said notch.

* * * * *